US009999573B2

(12) United States Patent
Cross

(10) Patent No.: US 9,999,573 B2
(45) **Date of Patent: *Jun. 19, 2018**

(54) COLOR CHANGING SILICONE SLEEVES

(71) Applicant: James Richard Cross, Melbourne (AU)

(72) Inventor: James Richard Cross, Melbourne (AU)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/562,776

(22) Filed: Dec. 8, 2014

(65) Prior Publication Data

US 2015/0250684 A1 Sep. 10, 2015

Related U.S. Application Data

(63) Continuation-in-part of application No. 14/201,923, filed on Mar. 10, 2014.

(51) Int. Cl.
*A61J 9/08* (2006.01)
*A61J 9/06* (2006.01)

(52) U.S. Cl.
CPC ..... *A61J 9/06* (2013.01); *A61J 2200/72* (2013.01); *A61J 2205/20* (2013.01)

(58) Field of Classification Search
CPC .. A61J 9/08; A61J 9/02; A61J 2200/72; A61J 2205/20
USPC ..... 206/459.1, 320; 220/737, 739; 215/395, 215/396
See application file for complete search history.

(56) References Cited

U.S. PATENT DOCUMENTS

| | | | | |
|---|---|---|---|---|
| 2,706,571 | A | 4/1955 | Ryan | |
| 4,919,983 | A * | 4/1990 | Fremin | A61J 9/02 215/11.2 |
| 6,865,815 | B1 | 3/2005 | Dunn et al. | |
| 7,938,260 | B2 * | 5/2011 | Lin | A45C 11/00 206/320 |
| 8,132,683 | B2 * | 3/2012 | Rund | A61J 9/08 206/446 |
| 2005/0103200 | A1 * | 5/2005 | Huik | A47J 31/106 99/279 |
| 2009/0057257 | A1 | 3/2009 | Marcus et al. | |
| 2010/0224585 | A1 | 9/2010 | Feeley et al. | |
| 2014/0216973 | A1 * | 8/2014 | Chang | B65D 81/022 206/521 |

* cited by examiner

*Primary Examiner* — King M Chu

(57) ABSTRACT

The present invention relates to a removable, efficiently shock absorbing, protective and heat sensitive, color changing silicone sleeve for baby feeding glass bottles or containers. The sleeve presents an innovative way to insert the baby bottle into the sleeve through the side openings as opposed to the conventional way of fitting the baby bottle through the top of the sleeve.

9 Claims, 11 Drawing Sheets

COLOR CHANGING SILICONE SLEEVES

CROSS-REFERENCE TO RELATED APPLICATIONS

This application is a continuation-in-part application of application Ser. No. 14/201,923 filed on Mar. 10, 2014.

BACKGROUND OF INVENTION

Field of Invention

The present invention relates to a removable, efficiently shock absorbing, protective and heat sensitive, color changing silicone sleeve for baby feeding glass bottles or containers.

Description of Prior Art

Consumer market for baby products is vast and ever expanding. Specifically talking about safety products for baby bottles or containers, there are umpteen options available to the consumers. Various competitive products in the market comprise silicone sleeves based baby feeding glass bottles. These bottles consist of breakage free, heat insulating, comfortable gripping surface based silicone sleeves for protecting baby feeding glass bottles from undue damage, preventing babies from burns and facilitating easy transportation. Such silicone sleeves definitely serve the purpose of an insulating protective cover for baby feeding glass bottles or containers but fail to test the approximate temperature of the baby glass bottle contents just by viewing only, without involving the actual need of physically sensing or wrist testing the bottle contents in order to gauge the temperature of the liquid food inside. The present invention also goes a step further by providing an efficient shock absorbing system in the form of bumpers with air pockets at the four corners of the color changing silicone sleeve. These air pockets further comprise of silicon tubes and silicone supporting beams which prevent the air pockets to collapse upon application of pressure. Although there are prior arts discussing about various shock absorbing systems or elements in the silicone sleeves for containers but none of them utilizes the concept of air pockets with supporting beams or silicone tubing as discussed above. Examples like US Pat. Application No. 20090057257 to Marcus et al. (2009); U.S. Pat. No. 6,865,815 to Dunn et al. (2005); have already been discussed in the parent application.

Another U.S. Pat. No. 2,706,571 to Ryan (1955) discusses about a shield for nursing bottle adapted to protect the bottle against breakage. The shield has two-stage cushioning action including an initial stage of soft cushioning through springing of the walls of the shield, and a stage of cushioning involving compression of bumper beads at the extremities of the shield. Furthermore, in order to conveniently adhere the sleeve to the bottle, there are annular beads projecting inwardly from the surface of the sleeve. These annular beads are spaced axially from the bumper beads permitting them to stretch or contract in order to conform to slightly varying bottle diameters. On the contrary, applicant's invention does not utilize bumper or annular beads as shock absorbing elements. Instead, the applicant's invention incorporates special bumpers with air pockets as shock absorbing elements at the four corners of the color changing silicone sleeve. These air pockets are further supported either by a mesh of supporting beams made of silicone, created from the same mould as the silicone sleeve; or by a circular tubing made of silicone. Adding supporting elements i.e. silicone beams and silicone circular tubing inside the air pockets prevent collapsing of these air pockets in the event of fall or slipping of the baby bottle. Thus, making the silicone sleeve efficiently impact resistant. Moreover, Ryan's Bottle Muff uses annular beads projecting inwardly from the surface of the sleeve. However these annular beads can create a gap between the bottle and the sleeve's wall. This could further lead to issues when the baby attempts to grip the bottle with the sleeve put on. The Baby has to press hard to push the sleeve's wall close to the bottle in order to achieve a tight grip. A Baby's grip is not that strong and hence this may cause problems. On the contrary, the applicant's color changing sleeve's design incorporates large windows or cut outs on both the sides of the sleeves, leaving two reasonably thin side walls. The side walls of the sleeve stay in contact with the bottle to ensure easy grip. Since, there are two large windows or cut outs in the applicant's sleeve's design, it renders an adequate level of friction that is required to grip the bottle.

Another US Pat. Application No. 2010/0224585 A1 to Feeley et al. (2010) discusses about impact resistant casing for breakable containers. This application primarily talks about the shock absorbers comprising of elastomeric protuberance that extends outward from the surface of the structural material. These elastomeric protuberances can be in the form of rings, concentric rings and conical shapes. The shock absorbers can be placed at any conceivable location around the breakable container to reduce the frequency of breakage upon an impact. On the contrary, applicant's sleeve's shock absorbing system is completely different from the one proposed by Feeley et al. Applicant does not employ elastomeric protuberances of any kind Applicant's shock absorbing system or it's elements are hidden from the outer surface of the silicone sleeve and is only identifiable as pronounced bumps i.e. airbags at the corners. Feeley et al. also talks about a coating on the inner surface of silicone casing to facilitate the application and removal of the silicone casing from the container. It is also indicated that such an inner coating may be made up of phthalate esters, which are potentially hazardous for babies. On the other hand, applicant's color changing silicone sleeve does not have any inner coating or coating on the inner surface of the sleeve. The main reason for providing an inner coating is the fact that Feeley's silicone casing design possess a high level of contact between the container and the side walls of silicone casing, thus it becomes necessary to incorporate a coating to facilitate easy insertion and removal of the casing. However, applicant's sleeve's design exhibits two large cut outs or openings thereby eliminating the need of any inner surface coating to facilitate insertion or release of the sleeve from the container. Hence, the present invention is a substantial improvement over the existing prior arts.

SUMMARY OF THE INVENTION

The present invention comprises a removable, protective, heat sensitive and color changing silicone sleeve for baby feeding glass bottles or containers. The present invention comes in various colors and dimensions. The present invention has two large openings or cut out windows at the front and back, leaving two reasonably thin adjacent side walls. The side walls of the sleeve stay in contact with the baby bottle to ensure an easy grip. It is therefore an object of invention to overcome the drawbacks of prior art and offer improved and advantageous features in the present invention.

It is an object of invention to provide a heat sensitive color changing silicone sleeve which tends to change color when the baby food inside the feeding bottle or container reaches a stated hot temperature. The phenomenon behind the sleeve color change is thermochromism. A predetermined quantity of thermochromic additive CHROMAZONE® is mixed with silicone during the manufacturing process.

It is further an object of invention to provide a heat sensitive, color changing silicone sleeve wherein the silicone sleeve changes the original color to a cautionary color upon reaching the stated hot temperature. The cautionary color may be white but not limited to any particular color.

It is yet another object of invention to incorporate special safety bumpers with air pockets as shock absorbing elements at the four corners of the color changing silicone sleeve. These air pockets are further supported either by a mesh of supporting beams made of silicone, created from the same mould as the silicone sleeve; or by a circular tubing made of silicone. Adding supporting elements i.e. silicone beams and silicone circular tubing inside the air pockets prevent collapsing of these air pockets in the event of fall or slipping of the baby bottle.

For a better understanding of the present invention, the matter disclosed henceforth will describe the invention and its preferred embodiments in the best possible manner.

BRIEF DESCRIPTION OF THE DRAWINGS

The embodiments of the present invention can be better understood with the help of accompanying drawings wherein.

DETAILED DESCRIPTION OF THE PREFERRED EMBODIMENTS

Figure 1:
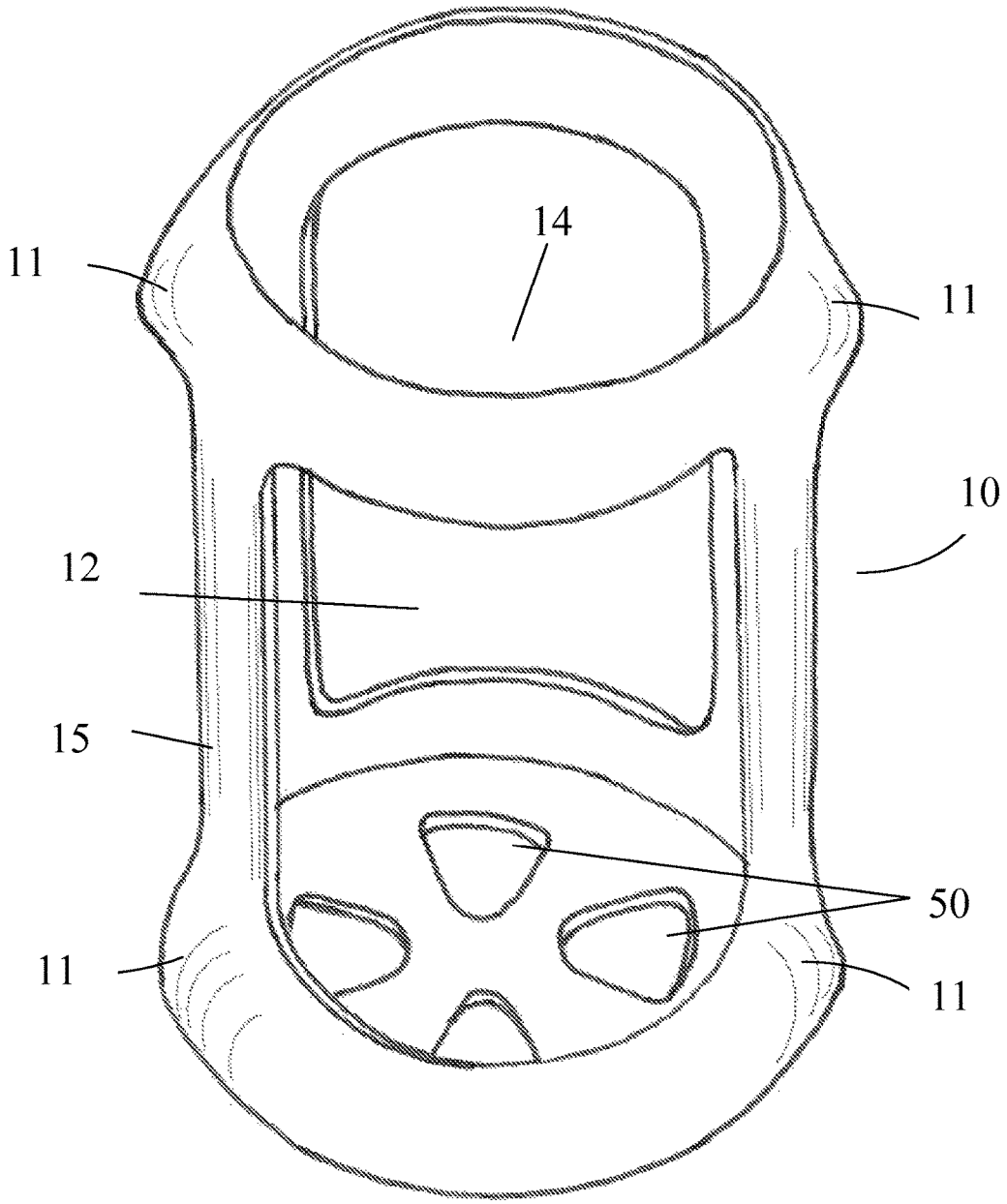
FIG. 1 shows the top perspective view of color changing silicone sleeve.

With reference to the drawing, in FIG. 1, a top perspective view of color changing silicone sleeve 10 is shown. The silicone sleeve 10 has two large side openings 12 and 14 at the front and back respectively. The side wall 15 of the sleeve has a preferable thickness of 1.5 mm but may vary from 0.5 mm-2 mm during the actual product development. Silicone used in manufacturing the product is the food grade silicone. The color changing silicone sleeve 10 is designed in such a manner that it ensures sufficient friction for the sleeve to grip the bottle. Due to adequate friction, there is an overall ease in fitting the baby bottle into the sleeve 10. The two large side openings 12 and 14 in the front and back respectively, allow the baby bottle to be inserted through the side openings as opposed to the conventional way of fitting the baby bottle through the top of the sleeve. The present design of the sleeve 10 does not require any internal coating of phthalate esters to facilitate fitting of the baby bottle within the sleeve. Conventional silicone sleeves are designed to be fitted into the baby bottles through the top opening of the sleeve and also the surface area of contact between such a sleeve and the baby bottle is comparatively larger than the present invention, which further additionally requires an internal coating within the sleeve's interior so as to facilitate a smooth fitting of the baby bottle within the sleeve. Since, the present invention has two large side openings 12 and 14 respectively, the overall area of contact of the sleeve 10 and baby bottle is far less as compared to the conventional counterparts. Hence, there is no need to include an internal coating of harmful phthalate esters within the sleeve 10. The present invention thus provides a phthalate free solution to the buyers. The preferable shore level for manufacturing the color changing silicone sleeve 10 is A40. However, during the actual manufacturing process, a shore level may assume any value between shore A20 to shore A80. The bottom of the color changing silicone sleeve 10 bears four triangular shaped holes 40. However any shape and number of openings can be embodied by the base of the sleeve 10. While inserting the baby bottle into the sleeve 10, an air bubble would often be created between the bottom of the sleeve 10 and the bottom of the baby bottle which causes bottle or sleeve to wobble when placed on surface. The present invention addresses and solves this problem by providing four triangular holes at the bottom of sleeve 10 to let the air escape from the bottom.

In FIG. 1, the color changing sleeve 10 bears bumpers 11 at the four edges or corners of the sleeve. The thickness of these bumpers is preferably 5 mm but may vary from 3-8 mm. The bumpers provide shock absorption capability to the container inside the sleeve so as to reduce the frequency of breakage upon an impact on the floor. Various embodiments of these bumpers are further discussed in the coming section.

Figure 2:
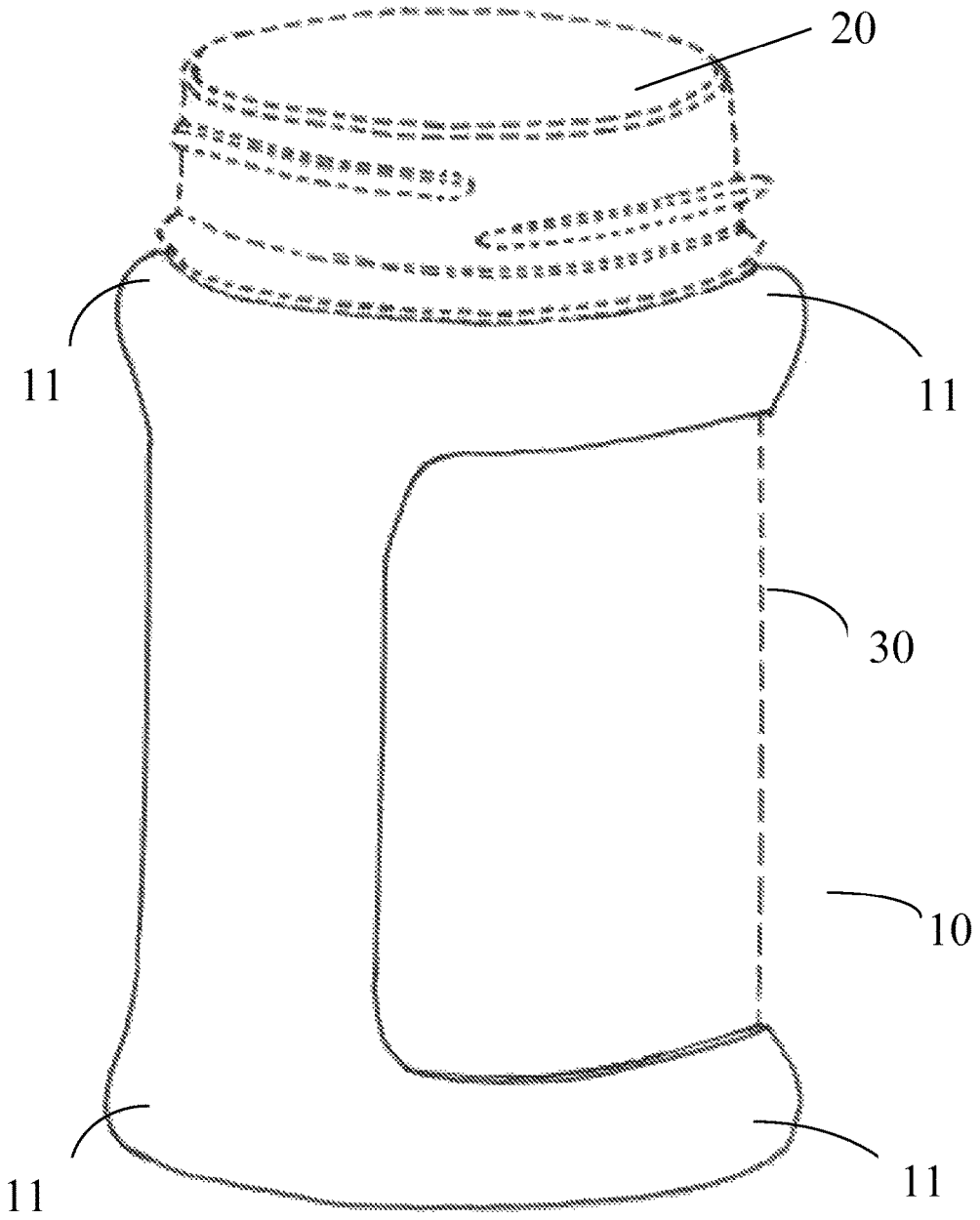
FIG. 2 shows the side perspective view of color changing silicone sleeve.

FIG. 2 illustrates a side perspective view of color changing silicone sleeve 10 inserted into a baby bottle 30 with collar 20 (as shown in broken lines). Bumpers 11 present at the four edges of the sleeve 10 provide an active shock absorption system to the sleeve. This sleeve design may also be adapted for use on adult drinking bottles whereby the bumpers offer an equally significant shock absorption if the person drops their glass drinking bottle.

Figure 3:
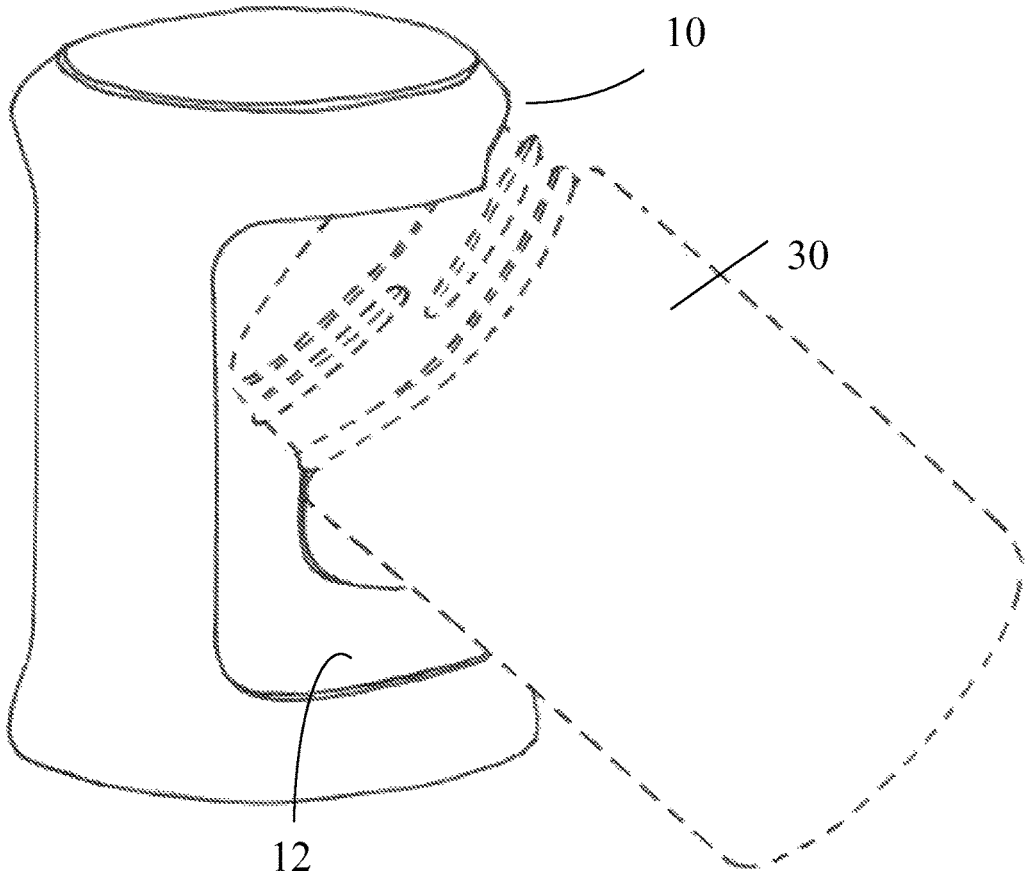
FIG. 3 illustrates the side perspective view of color changing silicone sleeve fitting the baby bottle.

FIG. 3 illustrates the side perspective view of color changing silicone sleeve 10 fitting the baby bottle 30 through the side window 12 of the sleeve. The present invention offers an innovative way of inserting the sleeve through one of the side window's unlike conventional sleeves wherein the baby bottle is inserted through the top opening of the sleeve.

Figure 4:
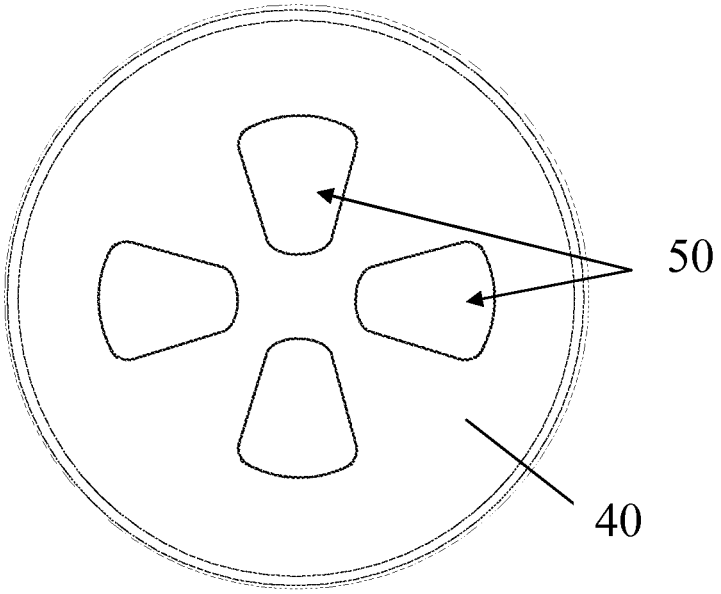
FIG. 4 shows the bottom plan view of color changing silicone sleeve.

FIG. 4 illustrates the bottom plan view of sleeve 10 with four triangular holes 50 at the base 40 of the sleeve. The four holes at the base create a "cross beam" design that acts as bracing to hold the side walls/corners of the sleeve 10 in place. This solves the problem of the corner lip of the sleeve 10 being stretched up too high (when sliding it over the bottle) thus losing protection of the sleeve at the corners.

Figure 5:
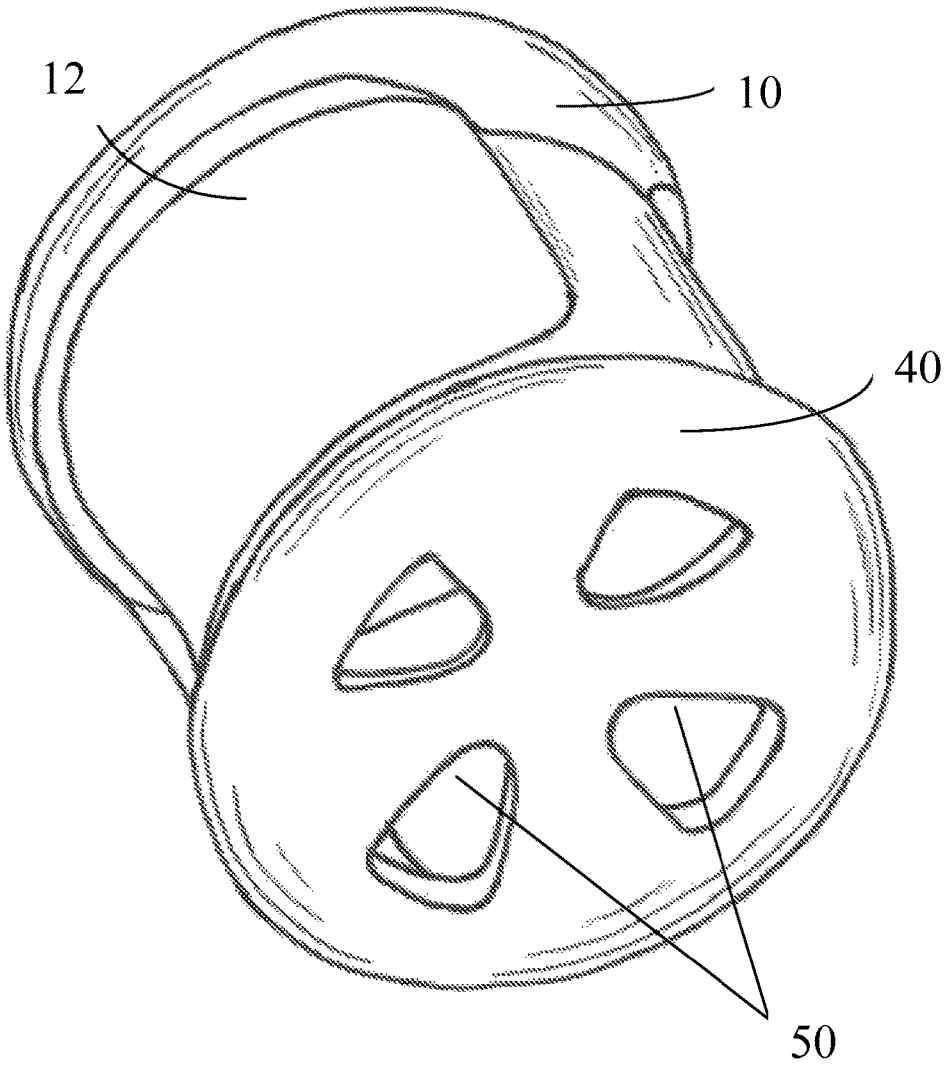
FIG. 5 shows the perspective bottom view of color changing silicone sleeve.

FIG. 5 shows the perspective bottom view of color changing silicone sleeve 10 with side window 12 and base 40 bearing triangular holes 50.

Figure 6:
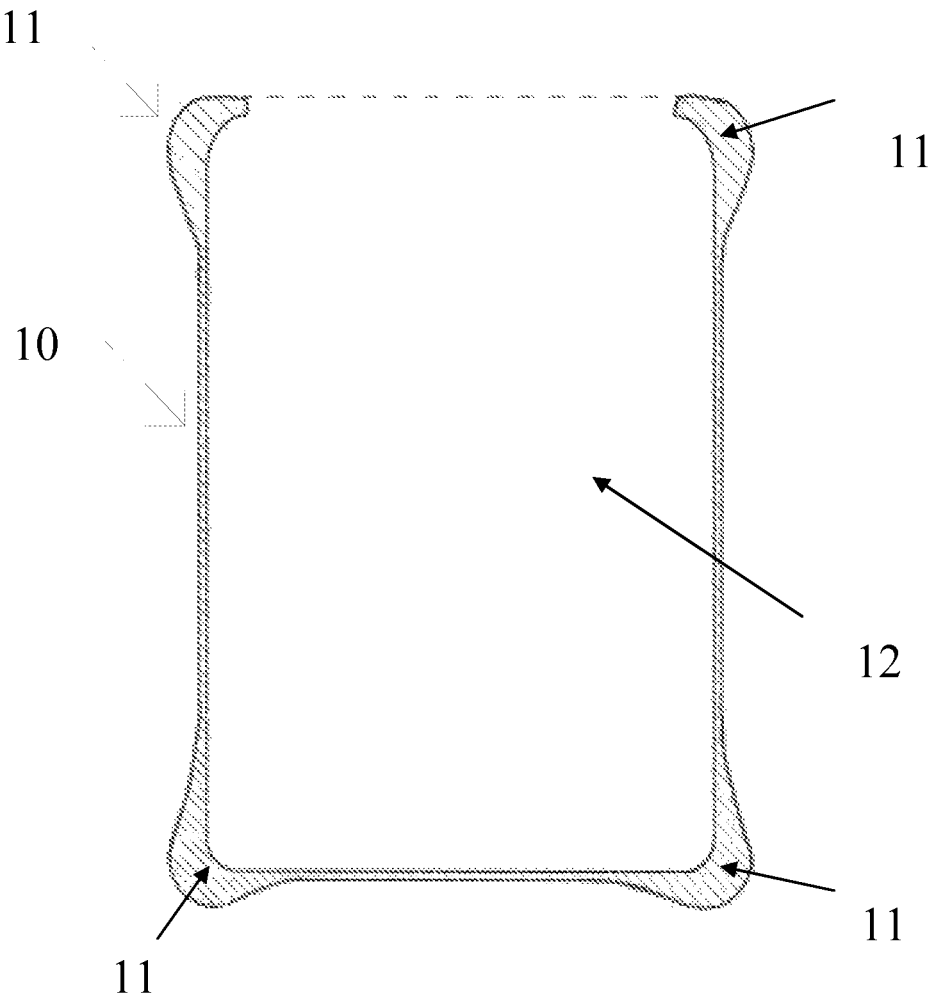
FIG. 6 illustrates the front plan view of color changing silicone sleeve with safety bumpers on the edges.

FIG. 6 illustrates the front plan view of color changing silicone sleeve 10 with safety bumpers 11 on the edges and 12 being one of side's window on the sleeve. As discussed before, the safety bumpers 11 provide shock absorption capability to the container inside the sleeve so as to reduce the frequency of breakage upon an impact on the floor. The thickness of these bumpers is preferably 5 mm but may vary from 3-8 mm. Other embodiments of these bumpers are further discussed below.

Figure 7:
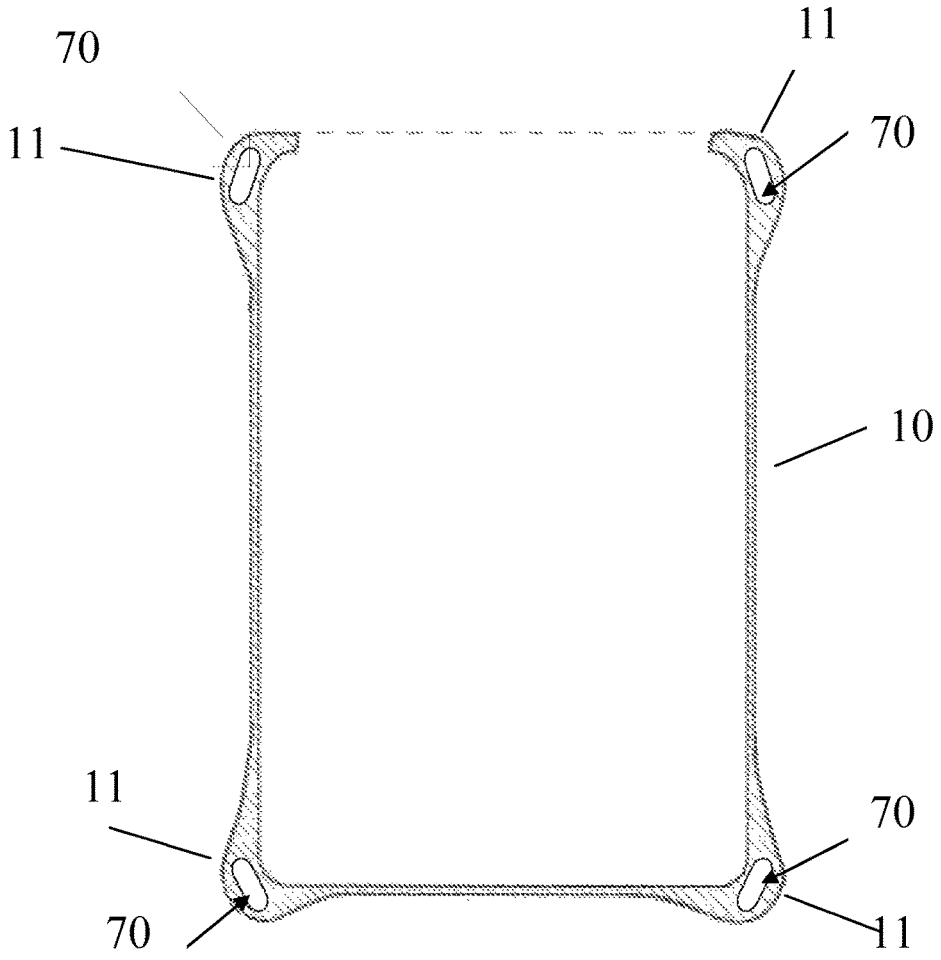
FIG. 7 illustrates the front plan view of color changing silicone sleeve with safety bumpers having closed air pockets on the edges.

FIG. 7 illustrates the front plan view of color changing silicone sleeve 10 with safety bumpers having closed air pockets 70 on the edges. In the event of accidental fall, these air pockets 70 inside each corner bumper 11 impart efficient and added shock absorption capability to the sleeve 10.

Figure 8:
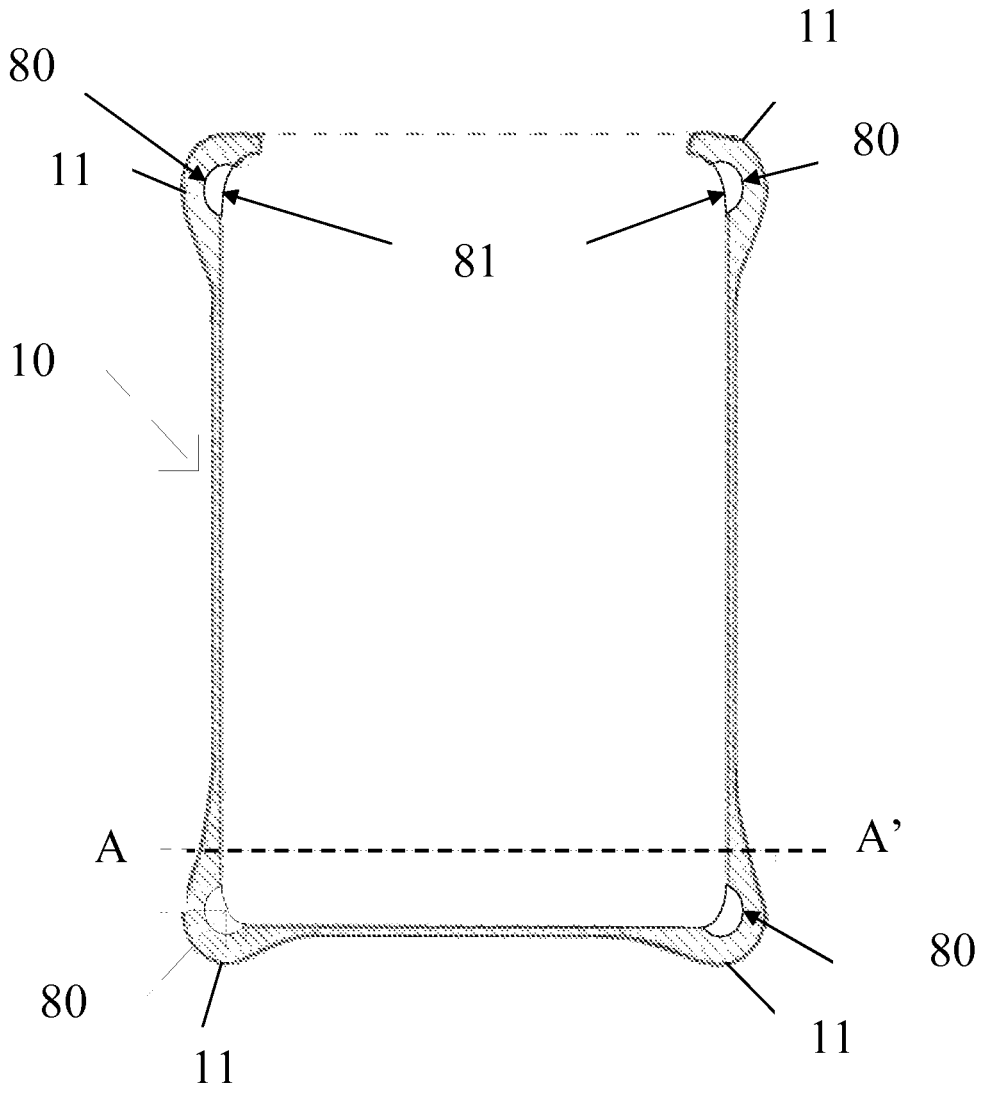
FIG. 8 illustrates the front plan view of color changing silicone sleeve with safety bumpers having C-shaped cut out on the edges.

FIG. 8 illustrates the front plan view of color changing silicone sleeve 10 with safety bumpers 11 having a C-shaped cut out or C-shaped air pocket 80 on the edges. The C-shaped cut out is further supported by supporting ribs/beams 81 made of silicone and created from the same mould as the silicone sleeve 10. The C-shaped cut out 80 with supporting rib 81 gives the same effect as the air bubble. Supporting ribs 81 ensure that the air pockets cannot easily collapse upon application of pressure. With the bottle inserted, it would seal the "cutout" 80 and effectively creates a cushioning bubble.

Figure 9:
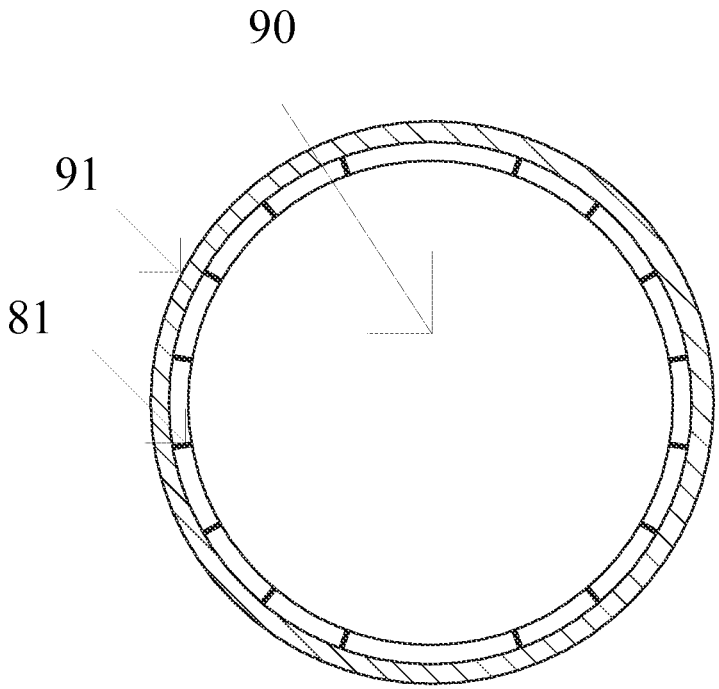
FIG. 9 illustrates the cross section along line A-A of FIG. 8.

FIG. 9 illustrates the cross section along line A-A of FIG. 8. The cross section shows the side wall of the sleeve 91 followed by supporting ribs 81 inside the side wall 91. 90 being the inside base of the sleeve 10.

Figure 10:
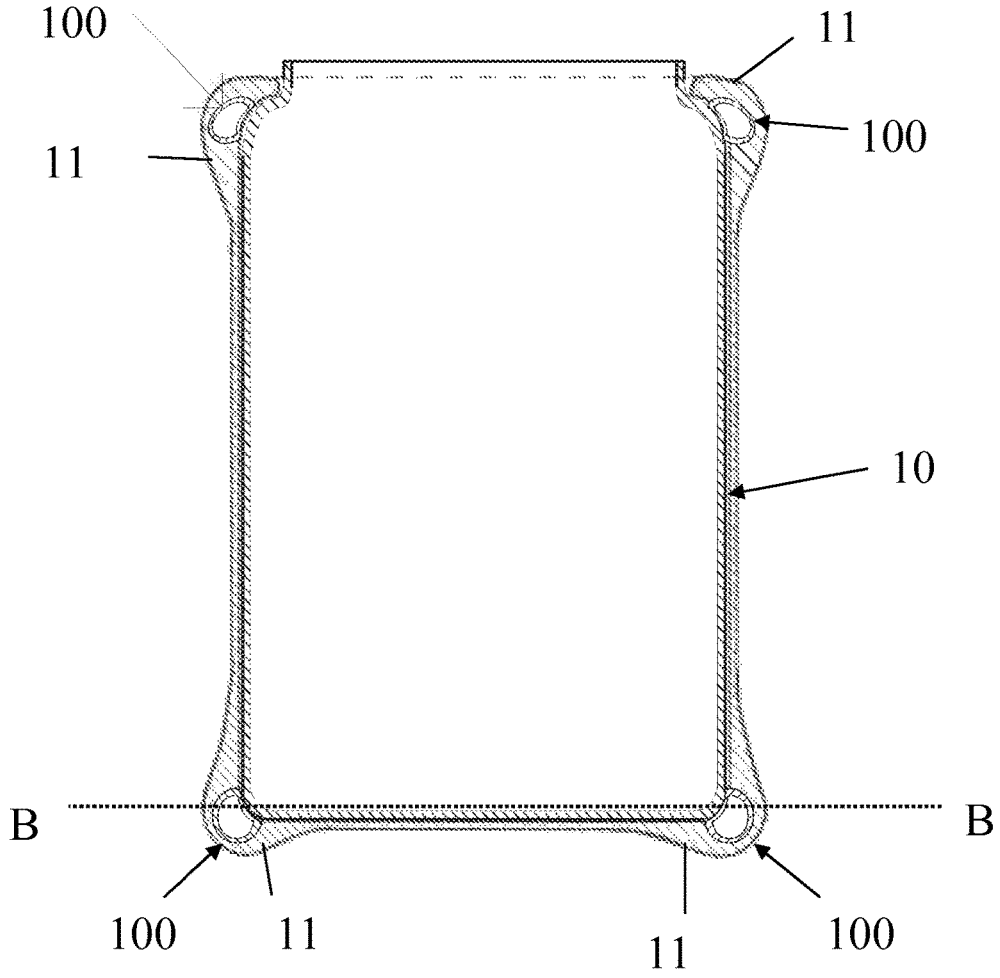
FIG. 10 illustrates the front plan view of color changing silicone sleeve with safety bumpers having circular silicone tubing on the edges.

FIG. 10 illustrates the front plan view of color changing silicone sleeve 10 with safety bumpers 11 having circular silicone tubing 100 on the edges. The circular silicone tubing 100 is hollow and this hollow section along within bumper 11 creates shock absorption properties as needed for the sleeve.

Figure 11:
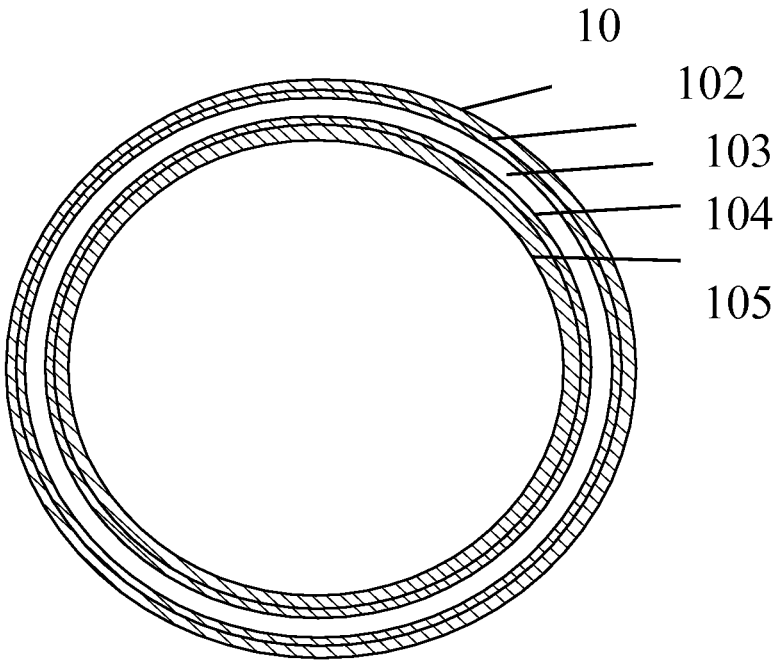
FIG. 11 illustrates the cross section along line B-B of FIG. 10.

FIG. 11 illustrates a circular cross section along line B-B of FIG. 10. The outer layer 10 represents the sleeve which is followed by the circular silicone tube wall 102. Circular silicone tube wall 102 is further followed by the tube cavity 103, which is further followed by the circular silicone tube wall 104. The innermost layer 105 represents the baby bottle surface.

To ensure the durability and estimate the shock absorption properties of the color changing silicone sleeve, several drop tests were performed. Below is the table presenting the same:

TABLE 1

| Drop Height (ft) | Sleeve without Bumpers | Sleeve with Bumpers alone | Sleeve with Bumpers and supporting Ribs |
|---|---|---|---|
| 2 | No bottles broke after 20 drops | No bottles broke after 20 drops | No bottles broke after 20 drops |
| 4 | 1 bottle broke after 20 drops | No bottles broke after 20 drops | No bottles broke after 20 drops |
| 6 | 11 bottle broke after 20 drops | No bottles broke after 20 drops | No bottles broke after 20 drops |
| 8 | 20 bottles broke after 20 drops | No bottles broke after 20 drops | No bottles broke after 20 drops |
| 10 | 20 bottles broke after 20 drops | No bottles broke after 20 drops | No bottles broke after 20 drops |
| 20 | 20 bottles broke after 20 drops | 2 bottle broke after 20 drops | No bottles broke after 20 drops |

Table 1 shows that the sleeve with bumpers and supporting ribs offered the most durability. None of the baby bottles broke after 20 drops when inserted into the sleeve with safety bumpers and supporting ribs even from a height of 20 feet. Sleeves with the safety bumpers alone also fared well, with only 2 bottles broken when dropped from a height of 20 feet after 20 drops. Whereas the sleeve with no safety bumpers offered the least durability from the experimented lot.

While the written description of the invention describes the invention in the best possible mode thereof, it is expected that the ordinary skilled in the art reckons the variations, modifications and combinations of the preferred embodiments. Therefore, the invention shall not be construed as limiting by the mentioned embodiments, methods, examples, terminologies or phraseologies, but by all embodiments and methods within the scope and ambit of the invention claimed.

What is claimed is:

1. A protective, heat sensitive and color changing silicone sleeve for baby feeding glass bottles or containers comprising:

a tubular shape with two large side openings;

a base bearing four triangular shaped openings;

safety bumpers at the edges of the silicone sleeve, wherein the safety bumpers contain circular silicone tubing, wherein the circular silicone tubing being hollow creates shock absorption properties for the sleeve in the event of accidental fall;

wherein the silicone sleeve changes its color to a cautionary color based on temperature of baby food inside the feeding bottle or container.

2. A protective, heat sensitive and color changing silicone sleeve according to claim 1, wherein the cautionary color is preferably white but not limited to a particular color.

3. A protective, heat sensitive and color changing silicone sleeve according to claim 1, wherein the two large side openings allow the baby bottle to be inserted through the side openings as opposed to the conventional way of fitting the baby bottle through the top of the sleeve.

4. A protective, heat sensitive and color changing silicone sleeve according to claim 1, wherein the four triangular openings at the bottom of sleeve let the air escape from the bottom and thus prevents an air bubble being created between the sleeve and the bottom of the baby bottle which may cause the baby bottle to wobble when placed on the surface.

5. A protective, heat sensitive and color changing silicone sleeve according to claim 4, wherein the four triangular openings at the base create a cross beam design that acts as bracing to hold the side walls or corners of the sleeve in place.

6. A protective, heat sensitive and color changing silicone sleeve according to claim 1, wherein the sleeve bears safety bumpers at the edges or corners of the sleeve, wherein the safety bumpers provide shock absorption capability to the container inside the sleeve so as to reduce the frequency of breakage upon an impact on the floor.

7. A protective, heat sensitive and color changing silicone sleeve according to claim 6, wherein the safety bumpers contain a C-shaped cut out forming a C-shaped air pocket, wherein the C-shaped cut out is further supported by supporting ribs or beams made of silicone and created from the same mould as the silicone sleeve, wherein the supporting ribs ensure that the air pockets cannot easily collapse upon application of pressure and would seal the C-shaped cut out and effectively creates a cushioning bubble when the baby feeding glass bottle is inserted.

8. A protective, heat sensitive and color changing silicone sleeve according to claim 6, wherein the safety bumpers contain closed air pockets, wherein the closed air pockets inside each corner bumper impart efficient and added shock absorption capability to the sleeve in the event of accident fall.

9. A protective, heat sensitive and color changing silicone sleeve for baby feeding glass bottles according to claim 1, wherein the silicone sleeve is also utilized for encasing drinking water bottles.

* * * * *